US011674735B2

(12) United States Patent
Zentner

(10) Patent No.: US 11,674,735 B2
(45) Date of Patent: Jun. 13, 2023

(54) REFRIGERATOR APPLIANCE WITH MOVABLE CONTROL MODULE

(71) Applicant: Haier US Appliance Solutions, Inc., Wilmington, DE (US)

(72) Inventor: Martin Mitchell Zentner, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 51 days.

(21) Appl. No.: 17/154,433

(22) Filed: Jan. 21, 2021

(65) Prior Publication Data

US 2022/0228791 A1 Jul. 21, 2022

(51) Int. Cl.
*F25D 17/06* (2006.01)
*F25D 29/00* (2006.01)

(52) U.S. Cl.
CPC ..... *F25D 17/065* (2013.01); *F25D 29/005* (2013.01); *F25D 2317/061* (2013.01); *F25D 2317/063* (2013.01); *F25D 2700/121* (2013.01)

(58) Field of Classification Search
CPC ..... F25D 17/065; F25D 29/005; F25D 2317/061; F25D 2317/063; F25D 2700/121; F25D 17/045
See application file for complete search history.

(56) References Cited

U.S. PATENT DOCUMENTS 4,671,074 A 6/1987 Gostelow et al.
5,421,247 A * 6/1995 Shim ..... C12H 1/00 99/468
5,816,061 A 10/1998 Lee et al.
7,159,413 B2 1/2007 Dail
10,288,340 B2 * 5/2019 Besore et al. ..... F25D 17/06 62/408
2004/0148949 A1 * 8/2004 Parachini et al. ..... F25B 49/00 62/126
2005/0155372 A1 * 7/2005 Dentella et al. ..... F25D 11/02 62/441
2009/0090734 A1 * 4/2009 Wittern, Jr. et al. .... G06F 17/00 221/1
2017/0163437 A1 * 6/2017 Yang et al. ..... H04L 12/28
2019/0003758 A1 * 1/2019 Scalf et al. ..... F25D 11/02
2020/0284493 A1 * 9/2020 Lee et al. ..... F25D 17/06

FOREIGN PATENT DOCUMENTS

DE 3604759 C2 11/1992

* cited by examiner

*Primary Examiner* — Elizabeth J Martin
*Assistant Examiner* — Dario Antonio Deleon
(74) *Attorney, Agent, or Firm* — Dority & Manning, P.A.

(57) ABSTRACT

A refrigerator appliance includes a cabinet with at least one food storage chamber defined in the cabinet. The refrigerator appliance also includes a sealed cooling system in fluid communication with the at least one food storage chamber via a multi-flow system. A plurality of independently cooled zones are defined within the at least one food storage chamber. The refrigerator appliance also includes a temperature control module selectively positionable in one of the plurality of zones. Methods of operating the refrigerator appliance may include and/or a controller of the refrigerator appliance may be configured for locating the temperature control module, receiving a temperature setting from the temperature control module, and adjusting operation of at least one of the sealed cooling system and the multi-flow system in response to the received temperature setting from the temperature control module.

20 Claims, 7 Drawing Sheets

REFRIGERATOR APPLIANCE WITH MOVABLE CONTROL MODULE

FIELD OF THE INVENTION

The present subject matter relates generally to refrigerator appliances, and more particularly, to refrigerator appliances having a plurality of independently-cooled zones and a temperature control module selectively positionable in one of the plurality of zones.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

However, various different food items may have differing storage requirements. Certain refrigerator appliances include multiple compartments or multiple distinct zones within a compartment configured for maintaining different temperatures for storing different types of food and drink items. However, implementing different temperatures in each of the compartments or zones of such refrigerator appliances typically requires multiple settings to be adjusted on a user interface of the refrigerator appliance. Such adjustments may be cumbersome when moving food items around within the refrigerator appliance, and/or when adding or removing food items of various types to or from the refrigerator appliance.

Accordingly, a refrigerator appliance including features for quickly and conveniently adjusting or monitoring temperature settings within one or more compartments or zones of the refrigerator appliance would be useful.

BRIEF DESCRIPTION OF THE INVENTION

Aspects and advantages of the invention will be set forth in part in the following description, or may be apparent from the description, or may be learned through practice of the invention.

In one exemplary aspect, a refrigerator appliance is provided. The refrigerator appliance includes a cabinet with at least one food storage chamber defined in the cabinet. The refrigerator appliance also includes a sealed cooling system in fluid communication with the at least one food storage chamber via a multi-flow system. A plurality of zones are defined within the at least one food storage chamber and the multi-flow system is configured to selectively direct air cooled by the sealed cooling system to one or more of the zones. As a result, each zone is cooled independently of every other zone. The refrigerator appliance also includes a temperature control module selectively positionable in one of the plurality of zones. A controller is in operative communication with the multi-flow system. The controller is configured for locating the temperature control module, receiving a temperature setting from the temperature control module, and adjusting operation of at least one of the sealed cooling system and the multi-flow system in response to the received temperature setting from the temperature control module.

In another exemplary aspect, a method of operating a refrigerator appliance is provided. The refrigerator appliance includes a cabinet with at least one food storage chamber defined in the cabinet, a sealed cooling system in fluid communication with the at least one food storage chamber via a multi-flow system, and a plurality of zones within the at least one food storage chamber. The multi-flow system is configured to selectively direct air cooled by the sealed cooling system to one or more of the zones, whereby each zone is cooled independently of every other zone. The refrigerator appliance also includes a temperature control module selectively positionable in one of the plurality of zones. The method includes locating the temperature control module, receiving a temperature setting from the temperature control module, and adjusting operation of at least one of the sealed cooling system and the multi-flow system in response to the received temperature setting from the temperature control module.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
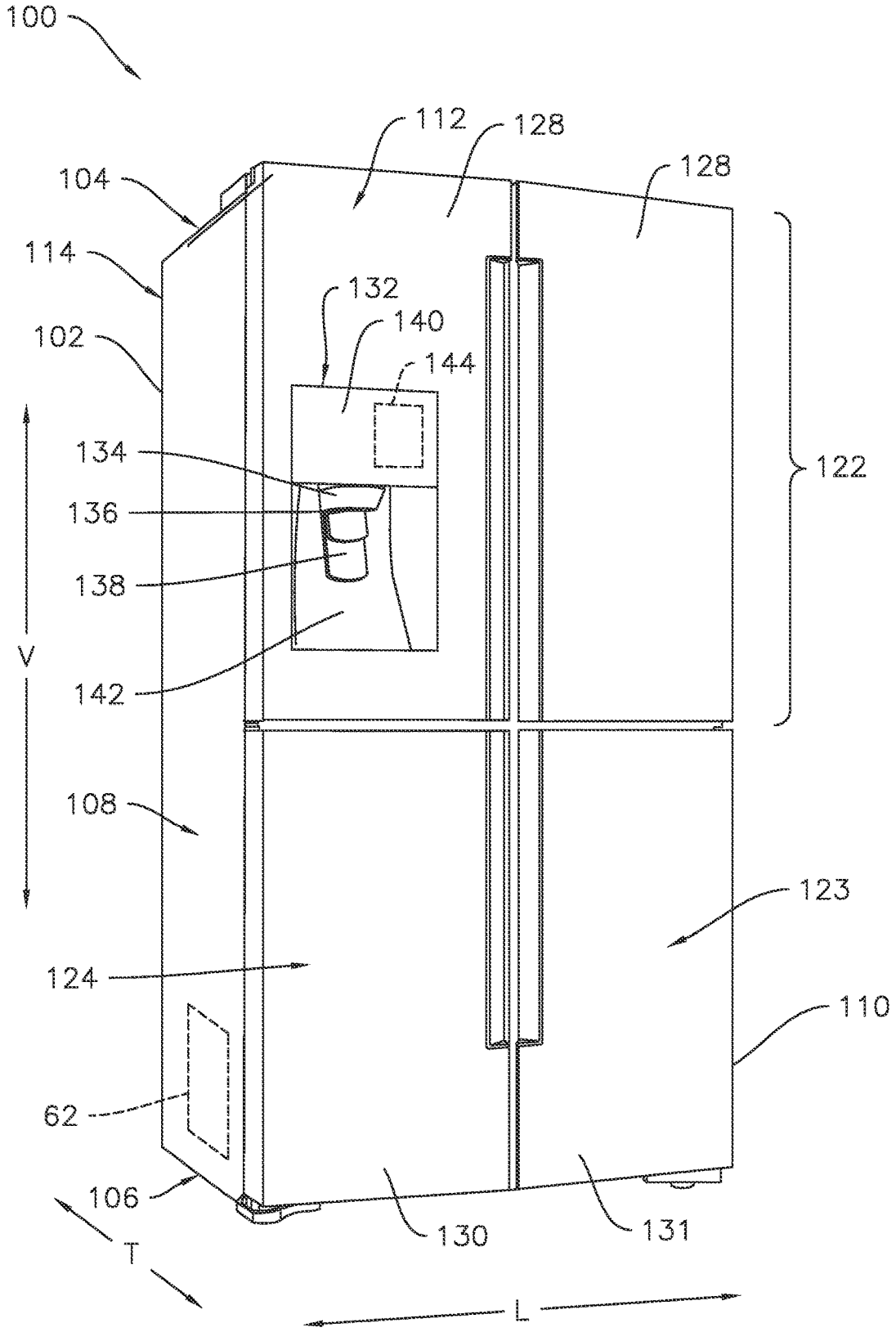
FIG. 1 provides a perspective view of a refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 provides a perspective view of a refrigerator appliance 100 according to an exemplary embodiment of the present subject matter. Refrigerator appliance 100 includes a housing or cabinet 102 that extends between a top 104 and a bottom 106 along a vertical direction V, between a left side 108 and a right side 110 along a lateral direction L, and between a front side 112 and a rear side 114 along a transverse direction T. Each of the vertical direction V, lateral direction L, and transverse direction T are mutually perpendicular to one another and form an orthogonal direction system.

Cabinet 102 includes at least one chilled chamber for receipt of food items for storage defined in the cabinet 102. In the particular example illustrated in FIGS. 1 and 2, cabinet 102 defines fresh food chamber 122 positioned at or adjacent top 104 of cabinet 102 with a freezer chamber 124 and a convertible chamber 123 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance, with or without the flexible chamber 123, including stand-alone refrigerator appliances with only the fresh food chamber 122 or stand-alone freezer appliances, etc. As another example, although the illustrated example embodiment depicts the freezer chamber 124 on the left side and the convertible chamber 123 on the right side, it is recognized that such configuration is provided by way of example only and not limitation, e.g., the freezer chamber 124 and the convertible chamber 123 may be transposed in some embodiments. Consequently, the description set forth herein is for illustrative purposes only and is not intended to be limiting in any aspect to any particular refrigerator chamber configuration.

Refrigerator doors 128 are each rotatably hinged to a corresponding edge of cabinet 102 for selectively accessing fresh food chamber 122. Similarly, freezer door 130 and convertible chamber door 131 are rotatably hinged to an edge of cabinet 102 in the illustrated example embodiment for selectively accessing freezer chamber 124 and convertible chamber 123. As another example, one or both of the freezer door 130 and the convertible chamber door 131 may instead be a front portion of a slidable drawer which can be selectively moved in and out of the respective chamber 123 and/or 124 along transverse direction T. To prevent leakage of cool air, the doors 128, 130, 131, and/or cabinet 102 may define one or more sealing mechanisms (e.g., rubber gaskets, not shown) at the interface where the doors 128, 130, 131 meet cabinet 102. Refrigerator doors 128, freezer door 130, and convertible chamber door 131 are shown in the closed configuration in FIG. 1 and in the open configuration in FIG. 2. It should be appreciated that doors having a different style, position, or configuration are possible within the scope of the present subject matter.

In an exemplary embodiment, cabinet 102 also defines a mechanical compartment 62 at or near the bottom 106 of the cabinet 102 for receipt of a hermetically sealed cooling system (FIG. 5) configured for transporting heat from the inside of the refrigerator to the outside. One or more ducts may extend between the mechanical compartment 62 and the chilled chambers 122, 123, and/or 124 to provide fluid communication therebetween, e.g., to provide chilled air from the hermetically sealed cooling system, e.g., from an evaporator 70 thereof, to one or more of the chilled chambers 122, 123, and/or 124. As is generally understood by those of skill in the art, the hermetically sealed system contains a working fluid, e.g., refrigerant, which flows between various heat exchangers of the sealed system where the working fluid changes phases. For example, the hermetically sealed system includes at least one evaporator 70 (FIG. 5) where the working fluid absorbs thermal energy and changes from a liquid state to a gas state and at least one condenser 66 where the working fluid releases thermal energy and returns to the liquid state from the gas state. As is understood, because the system is sealed, the working fluid is contained within the system and travels between the heat exchangers 66, 70 of the hermetically sealed system. A fan 72, 74 is typically provided at each heat exchanger of the sealed system. For example, a fan 74 may force air across and around the at least one evaporator 70 to transfer thermal energy from the air to the evaporator 70 (and more particularly, to the working fluid therein), thereby generating a flow of chilled air C which may be provided to one or more of the chilled chambers 122, 123, and/or 124.

Refrigerator appliance 100 may also includes a dispensing assembly 132 for dispensing liquid water and/or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of an adult user. According to an exemplary embodiment, the dispensing assembly 132 may receive ice from an icemaker disposed in a sub-compartment of the fresh food chamber 122.

Refrigerator appliance 100 further includes a controller 144. Operation of the refrigerator appliance 100 is regulated by controller 144 that is operatively coupled to control panel 140. In some exemplary embodiments, control panel 140 may represent a general purpose I/O ("GPIO") device or functional block. In some exemplary embodiments, control panel 140 may include input components, such as one or more of a variety of electrical, mechanical or electro-mechanical input devices including rotary dials, push buttons, touch pads, and touch screens. Control panel 140 can be communicatively coupled with controller 144 via one or more signal lines or shared communication busses. Control panel 140 provides selections for user manipulation of the operation of refrigerator appliance 100, e.g., whereby a user may provide one or more set point temperatures for the various compartments 122, 123, and 124. In response to user manipulation of the control panel 140, controller 144 operates various components of refrigerator appliance 100. For example, controller 144 is operatively coupled or in communication with various airflow components, e.g., dampers and fans, as discussed below. Controller 144 may also be communicatively coupled with a variety of sensors, such as, for example, chamber temperature sensors or ambient temperature sensors. Such chamber temperature sensors and/or ambient temperature sensors may be or include thermistors, thermocouples, or any other suitable temperature sensor. Controller 144 may receive signals from these temperature sensors that correspond to the temperature of an atmosphere or air within their respective locations.

Controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. For the embodiment depicted, the instructions may include a software package configured to operate the system, e.g., to execute exemplary methods of operating the refrigerator appliance 100. The memory can be a separate component from the processor or can be included onboard within the processor. Alternatively, controller 144 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. The controller 144 may be positioned in a variety of locations throughout refrigerator appliance 100. In the illustrated embodiment, the controller 144 is located within a control panel area 140 of one of the refrigerator doors 128, as shown in FIG. 1. In other example embodiments, the controller 144 may be positioned at or near the rear side 114 and/or the bottom 106 of the refrigerator appliance 100. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Figure 2:
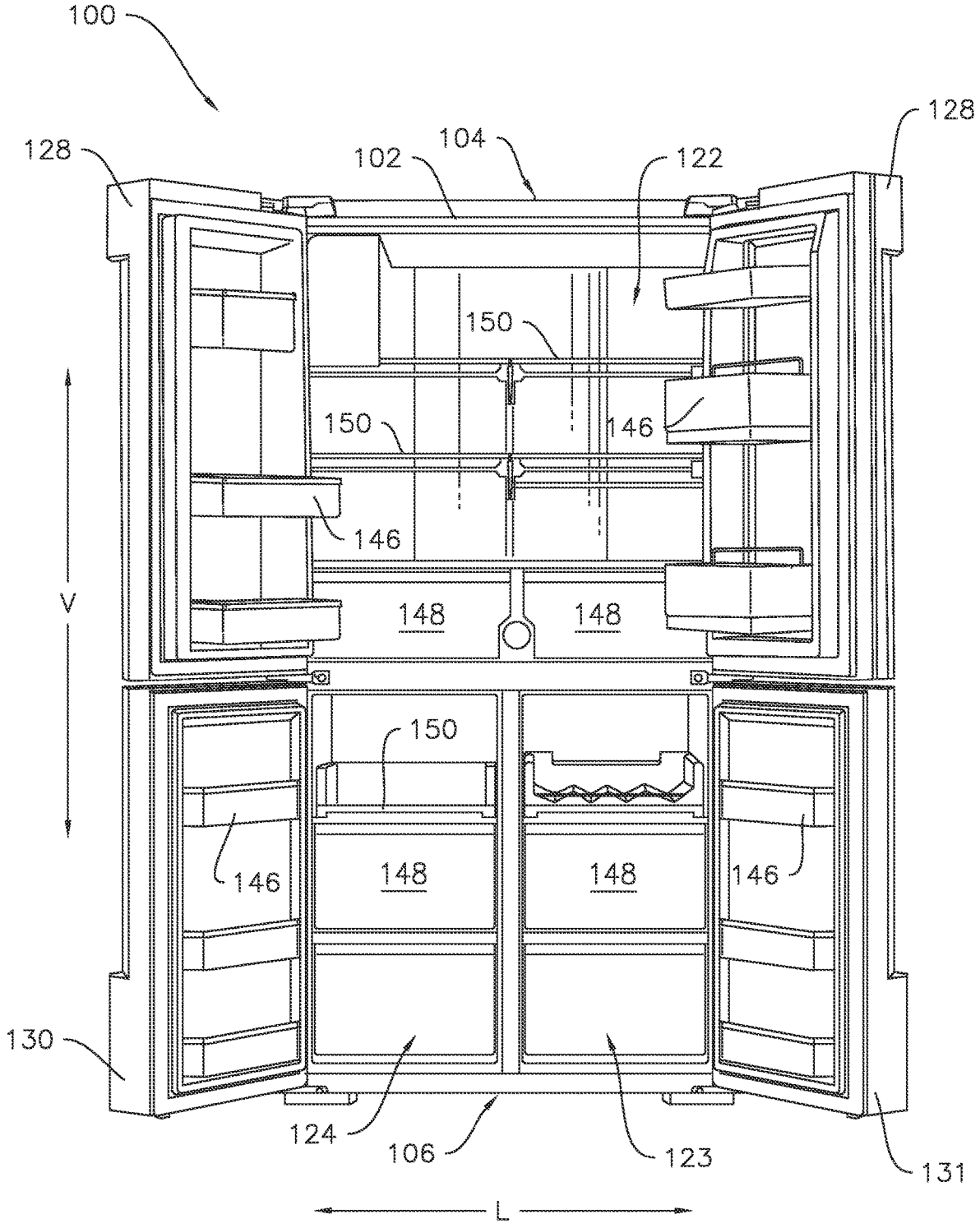
FIG. 2 provides a front view of the exemplary refrigerator appliance of FIG. 1 with the refrigerator and freezer doors of the refrigerator appliance shown in an open position.

FIG. 2 provides a front view of refrigerator appliance 100 with refrigerator doors 128, freezer door 130, and convertible chamber door 131 shown in an open position. According to the illustrated embodiment, various storage components are mounted within fresh food chamber 122, convertible chamber 123, and freezer chamber 124 to facilitate storage of food items therein as will be understood by those skilled in the art. In particular, the storage components include bins 146, drawers 148, and shelves 150 that are mounted within fresh food chamber 122, convertible chamber 123, or freezer chamber 124. Bins 146, drawers 148, and shelves 150 are configured for receipt of food items (e.g., beverages and/or solid food items) and may assist with organizing such food items. As an example, drawers 148 of fresh food chamber 122 can receive fresh food items (e.g., vegetables, fruits, and/or cheeses) and increase the useful life of such fresh food items.

Figure 5:
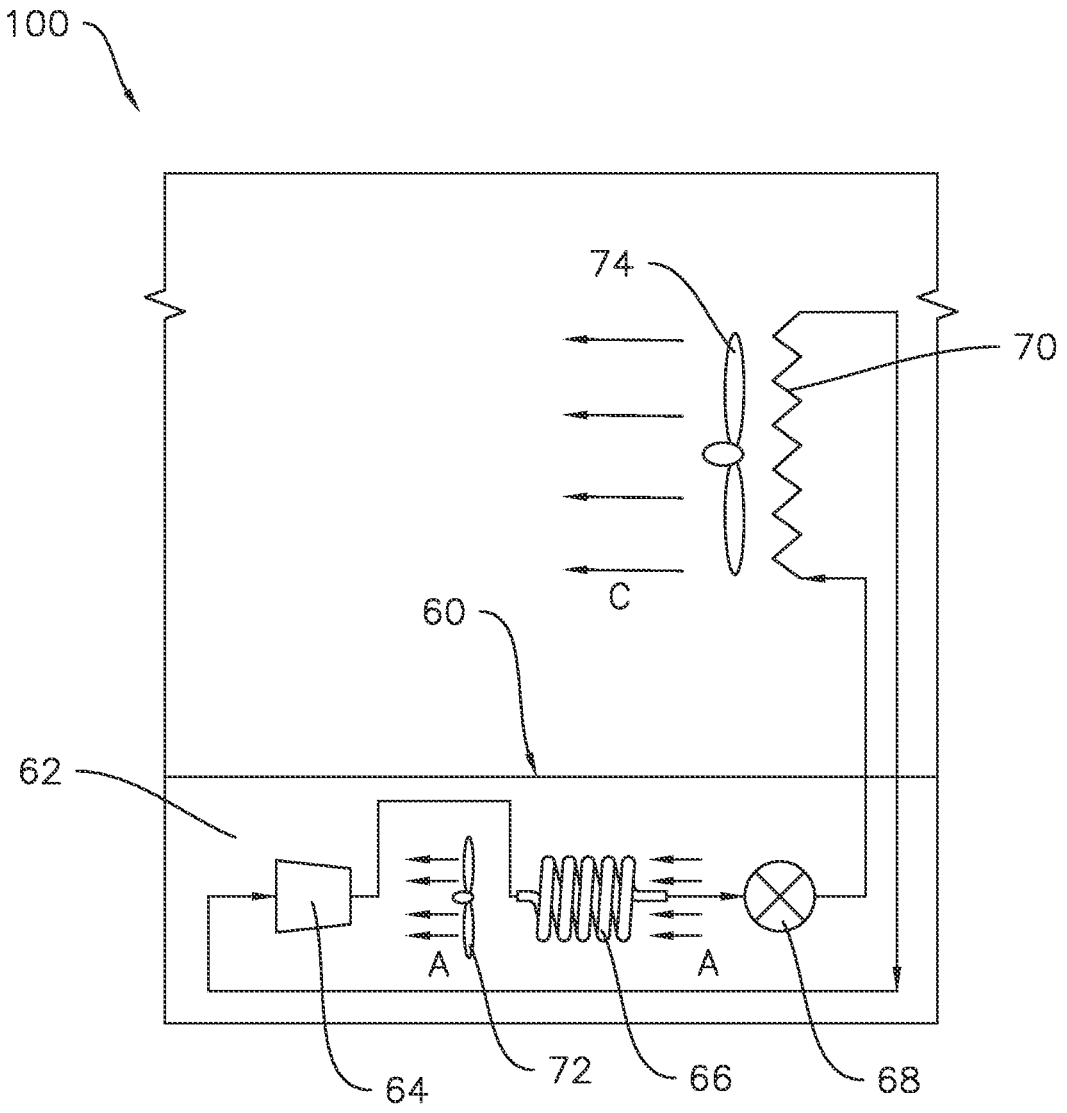
FIG. 5 is a schematic illustration providing an example of a sealed cooling system as may be used with one or more embodiments of the present subject matter.

Turning now to FIG. 5, an exemplary sealed cooling system is illustrated which may be incorporated into the refrigerator appliance 100 in some embodiments of the present disclosure. FIG. 5 is a schematic view of refrigerator 100 including an exemplary sealed cooling system 60. As mentioned above, refrigerator 100 includes a machinery compartment 62 that at least partially contains components for executing a known vapor compression cycle for cooling air. The components include a compressor 64, a heat exchanger or condenser 66, an expansion device 68, and an evaporator 70 connected in series and charged with a refrigerant. Evaporator 70 is also a type of heat exchanger which transfers heat from air passing over the evaporator to a refrigerant flowing through evaporator 70 thereby causing the refrigerant to vaporize. As such, cooled air C is produced and configured to refrigerate compartments 122, 123, 124 of refrigerator 100.

From evaporator 70, vaporized refrigerant flows to compressor 64, which operates to increase the pressure of the refrigerant. This compression of the refrigerant raises its temperature, which is lowered by passing the gaseous refrigerant through condenser 66 where heat exchange with ambient air takes place so as to cool the refrigerant. A fan 72 is used to pull air across condenser 66, as illustrated by arrows A, so as to provide forced convection for a more rapid and efficient heat exchange between the refrigerant and the ambient air.

Expansion device 68 further reduces the pressure of refrigerant leaving condenser 66 before being fed as a liquid to evaporator 70. Collectively, the vapor compression cycle components in a refrigeration circuit, associated fans, and associated compartments are sometimes referred to as a sealed refrigeration system operable to force cold air through refrigeration compartments 122, 123, 124. The refrigeration system depicted in FIG. 5 is provided by way of example only. It is within the scope of the present invention for other configurations of the refrigeration system to be used as well. For example, fan 74 may be repositioned so as to push air across evaporator 70, dual evaporators may be used with one or more fans, and numerous other configurations may be applied as well.

Figure 3:
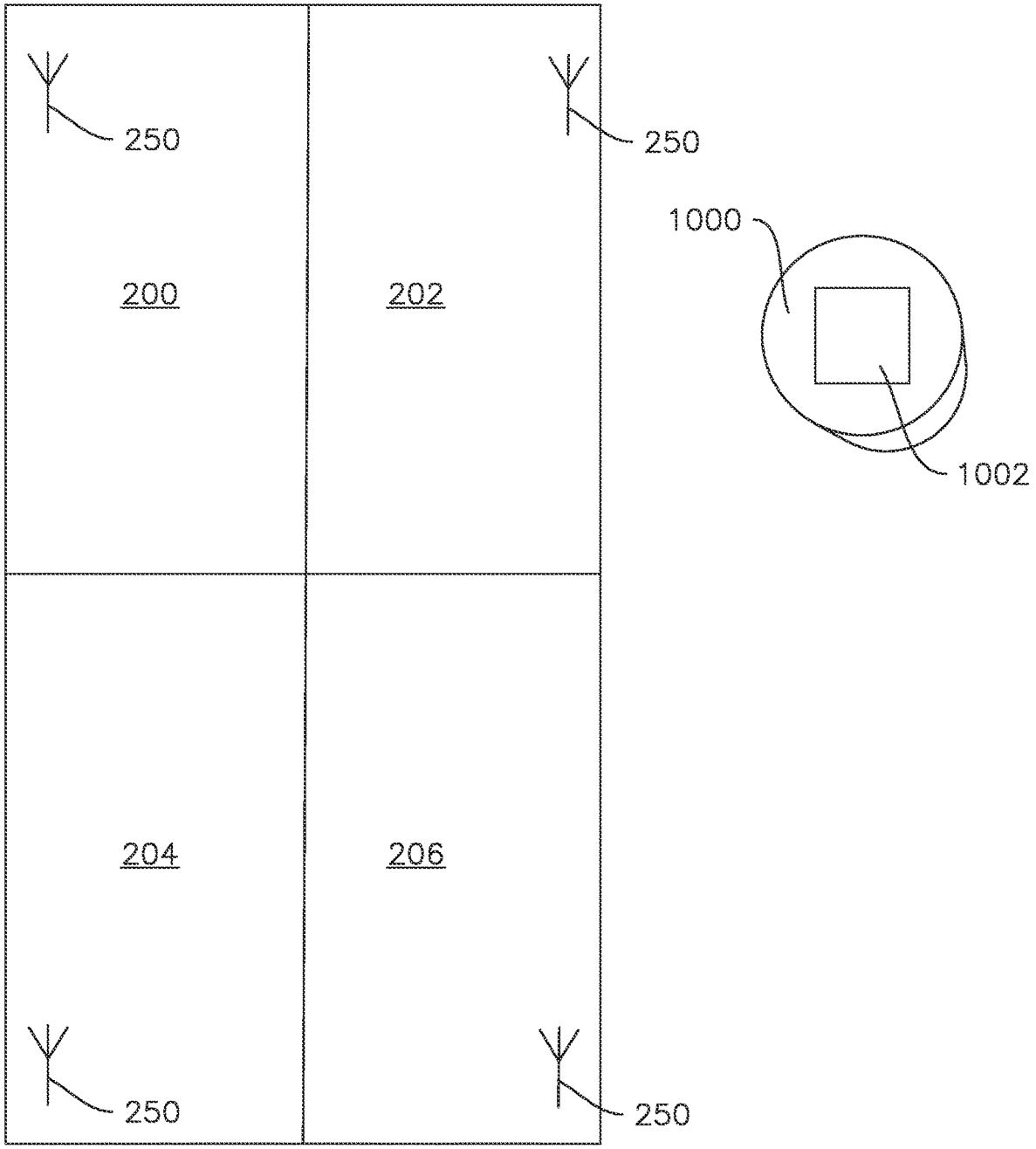
FIG. 3 provides a schematic view of a refrigerator appliance according to one or more exemplary embodiments of the present subject matter.

FIG. 3 schematically illustrates a plurality of independently cooled zones, e.g., four zones 200, 202, 204, and 206 as the illustrated example, which may be defined within one or more of the food storage chambers 122, 123, and 124. For example, in some embodiments, all of the zones, such as all four in the example illustrated in FIG. 3, may be distinct portions within the fresh food chamber 122. As another example, in additional embodiments, all of the zones may be defined within the convertible chamber 123 or the freezer chamber 124. In further example embodiments, the plurality of zones may be spread across multiple compartments or chambers in various combinations, such as a first two zones 200 and 202 of the plurality of zones in the fresh food chamber 122 while the freezer chamber 124 and convertible chamber 123 each represent a single zone, or two zones in one of freezer chamber 124 or convertible chamber 123. Additional combinations and variations of the plurality of zones 200, 202, 204, and 206 within at least one of the chambers 122, 123, and 124 are also possible within the scope of the present subject matter.

Also, in at least some embodiments, the zones may be adjustable in size. For example, in embodiments where two or more zones are defined in the fresh food chamber 122, the zones may be at least partially defined, e.g., bounded and/or delineated, by one or more of the shelves 150. In such embodiments, moving the shelf or shelves may permit changing or flexibility in the size of the independently cooled zones. As another example, additional partitions and/or partitions other than the shelves 150 may be provided which may partially define one or more zones and may also be movable to selectively adjust the size of the corresponding independently cooled zone or zones.

Also as illustrated in FIG. 3, the refrigerator appliance 100 may include or be operable with a temperature control module 1000 which is selectively positionable in one of the plurality of zones 200, 202, 204, and 206. The temperature control module 1000 may be operable to and configured to communicate, e.g., wirelessly, with the controller 144 (FIG. 1). The controller 144 may locate the temperature control module 1000, e.g., determine which zone of the plurality of zones 200, 202, 204, and 206 the temperature control module 1000 is located or placed in, and the controller 144 may then adjust operation of the refrigerator appliance 100, e.g., the sealed cooling system 60 (FIG. 5) and/or the multi-flow system (FIG. 6) thereof, to adjust a temperature within the zone in which the temperature control module 1000 is located based on a temperature setting received by the controller 144 from the temperature control module 1000.

In some embodiments, the temperature control module 1000 may include a user interface 1002, e.g., a touchscreen interface, for receiving input such as temperature settings from a user and/or for providing information to a user, such as displaying visual indicators and/or temperature readings or settings, etc. In some embodiments, the temperature control module 1000 may also or instead receive the user input from a remote user interface device, such as a personal computer, smartphone, tablet, smart home system, or other similar device. For example, the remote user interface device may be a smartphone and may run an application or "app," whereby the remote user interface device can receive a temperature setting in the app and then transmit the temperature setting wirelessly to the temperature control module 1000.

In some embodiments, e.g., as illustrated in FIG. 3, the refrigerator appliance 100 may include one or more wireless receivers 250, e.g., antennas, which is or are coupled to the controller 144 for sending and receiving signals to and from the controller 144 and the temperature control module 1000, e.g., the controller 144 may communicate with the temperature control module 1000 wirelessly via the one or more antennas 250. In embodiments which include more than one of the wireless receivers 250, the controller 144 may be configured for locating the temperature control module 1000 based on a wireless signal received from the temperature control module 1000 via the more than one wireless receivers 250. For example, the controller 144 may be configured for locating the temperature control module 1000 by triangulating the received wireless signal with the plurality of wireless receivers 250.

Figure 4:
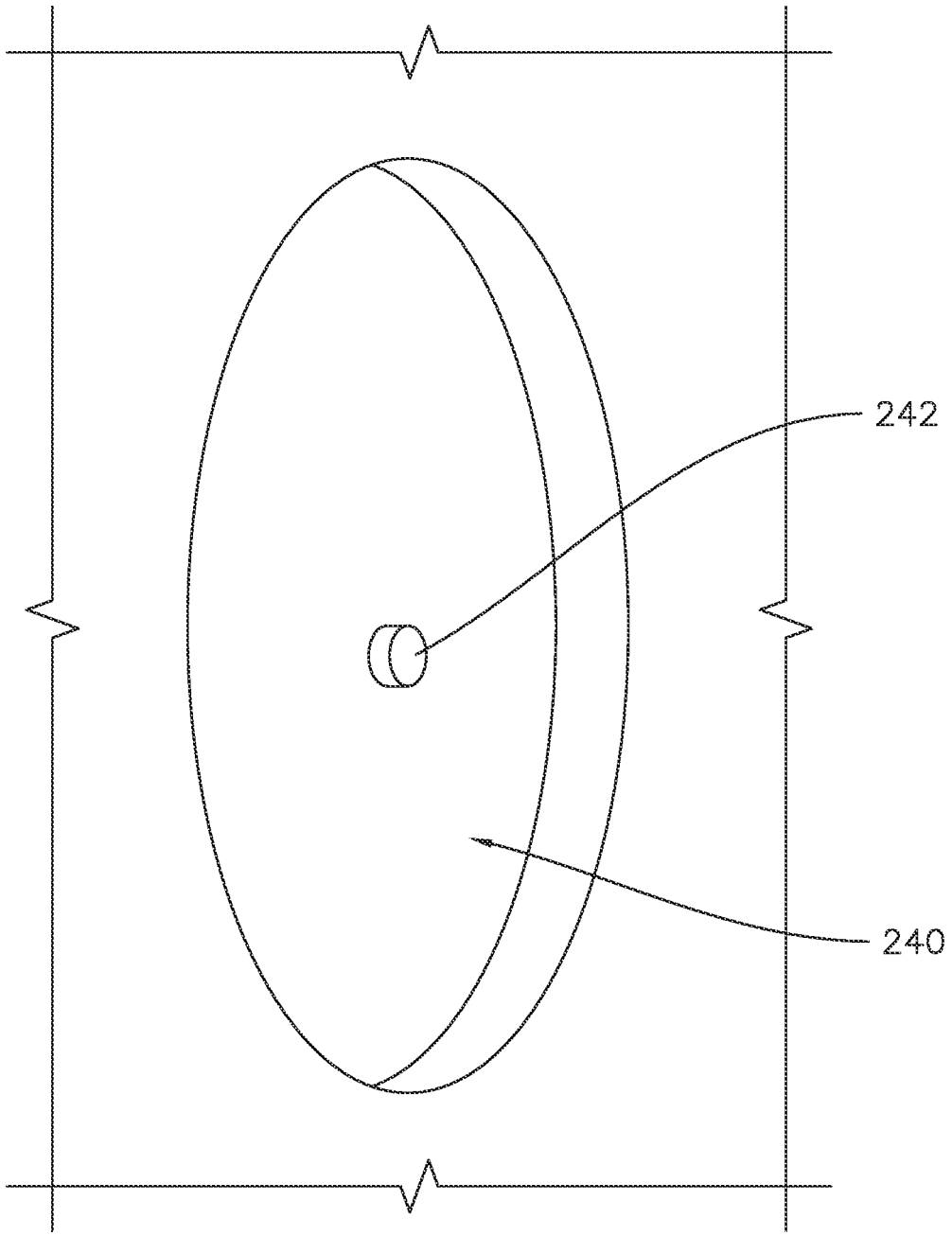
FIG. 4 provides an enlarged view of a portion of a refrigerator appliance according to one or more exemplary embodiments of the present subject matter.

Turning now to FIG. 4, in additional embodiments, the refrigerator appliance 100 may also or instead include a plurality of docking ports 240, an exemplary one of the docking ports 240 being illustrated in FIG. 4. The plurality of docking ports 240 may correspond, such as one-to-one, with the plurality of zones 200, 202, 204, and 206. For example, each docking port 240 may be located in one of the plurality of zones 200, 202, 204, and 206, and each zone of the plurality of zones 200, 202, 204, and 206 may have one docking port 240 therein. The docking ports 240 may each be configured, e.g., sized and shaped, to receive the temperature control module 1000 therein. For example, as illustrated in FIG. 3, the temperature control module 1000 may be generally puck-shaped, e.g., may be cylindrical with a diameter that is several times larger, e.g., two or three time larger, than the longitudinal axis. In such embodiments, the docking ports 240 may be shallow cylindrical recesses, e.g., as depicted in FIG. 4, within each zone 200, 202, 204, and 206 such that the temperature control module 1000 may nest partially within the respective docking port 240 for the zone in which the temperature control module 1000 is located. Also as may be seen in FIG. 4, each docking port 240 may include a mechanical switch 242 therein. Thus, when the temperature control module 1000 is received, e.g., nested, within the docking port 240, the temperature control module 1000 may contact and actuate the mechanical switch 242. The controller 144 may be operatively coupled to each mechanical switch 242 in the plurality of docking ports 240, such that the controller 144 may be configured to locate the temperature control module 1000 based on a signal received from the mechanical switch 242 when the mechanical switch 242 is actuated by the temperature control module 1000 located in the corresponding docking port 240.

In some embodiments, the refrigerator appliance 100 may also include a vision system, e.g., one or more cameras positioned and configured to capture images of the interior of the refrigerator appliance 100, such as the inside of the food storage chamber(s), e.g., fresh food chamber 122, including items stored therein. In such embodiments, the controller 144 may also or instead be configured for locating the temperature control module 1000 using the vision system. For example, data from the one or more cameras of the vision system may be transmitted to and processed by the controller 144, and the controller 144 may include software or programming for identifying the temperature control module 1000 and determining which zone the temperature control module 1000 is in based on the data from the camera(s).

Figure 6:
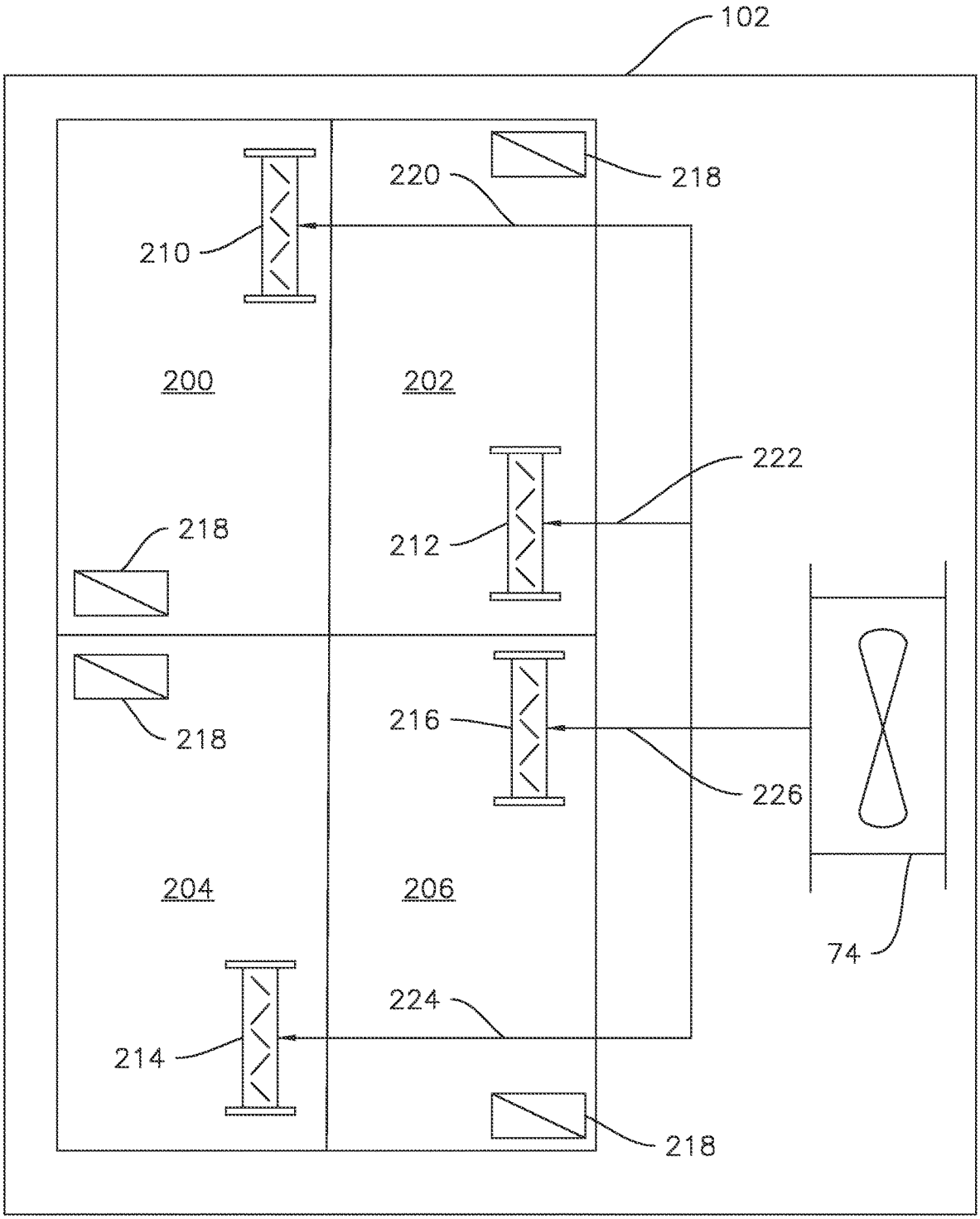
FIG. 6 provides a schematic view of a multi-flow system of a refrigerator appliance according to one or more exemplary embodiments of the present subject matter.

FIG. 6 schematically illustrates a multi-flow system for directing chilled air C (FIG. 5) selectively to one or more of the plurality of zones 200, 202, 204, and 206, whereby the plurality of zones 200, 202, 204, and 206 are each cooled independently of every other zone. Each zone of the plurality of zones 200, 202, 204, and 206 may be downstream of the sealed cooling system 60, such as downstream of a fan 74 thereof which directs chilled air C (FIG. 5) into the multi-flow system. In additional embodiments, multiple evaporators and/or multiple fans may be provided. As depicted in FIG. 6, the multi-flow system may include a plurality of ducts 220, 222, 224, and 226 which correspond to each zone of the plurality of zones 200, 202, 204, and 206, e.g., a first duct 220 extends to and/or provides fluid communication from the fan 74 to the first zone 200 of the plurality of zones 200, 202, 204, and 206, a second duct 222 extends to and/or provides fluid communication from the fan 74 to the second zone 202 of the plurality of zones 200, 202, 204, and 206, and so forth. The multi-flow system may also include a plurality of supply dampers 210, 212, 214, and 216 which also correspond to each zone of the plurality of zones 200, 202, 204, and 206. For example, each supply damper 210, 212, 214, and 216 may be positioned at a downstream end of a corresponding one of the ducts 220, 222, 224, and 226 to control, e.g., limit, regulate, and/or cut off, the flow of chilled air to the respective zone of the plurality of zones 200, 202, 204, and 206. Thus, where the supply dampers 210, 212, 214, and 216 are independently operable, the zones 200, 202, 204, and 206 may be independently cooled where each zone is cooled based on the position of the respective damper 210, 212, 214, and 216.

As illustrated in FIG. 6, the multi-flow system may also include at least one return 218 whereby air from the chamber, e.g., from the plurality of zones 200, 202, 204, and 206 therein returns to the sealed cooling system 60. In some embodiments, a single return 218 that is common to all zones, such as all four of the illustrated zones 200, 202, 204, and 206 may be provided. In other embodiments, each zone may have a dedicated return 218, e.g., as illustrated in FIG. 6. Additional, intermediate, combinations are also possible within the scope of the present subject matter. For example, such intermediate combinations may include four zones with two returns where the two returns are each common to two of the zones, such as a first return common to a first zone and a second zone and a second return common to a third zone and a fourth zone, or four zones and three returns with two zones each having a dedicated return and the other two zones having a common return, among numerous other possible combinations, including more or fewer zones than four zones. In embodiments which include more than one return 218, the returns 218 may also be independently controlled. For example, the returns 218 may be independently controlled in that each return 218 may be operable to open or close or adjust to an intermediate position between fully open position and fully closed position independently of every other return 218, such as independently of the position of every other return 218, and each return 218 may be adjustable without affecting the position of any other return 218. Thus, in some embodiments, the zones 200, 202, 204, and 206 may also be independently cooled in that the cooling in each zone is based on the position of the respective return 218.

For example, the temperature control module 1000 may receive a temperature setting, e.g., via the user interface 1002 or from a remote user interface device, for one of the zones 200, 202, 204, and 206, and the temperature control module 1000 may then relay the temperature setting to the controller 144 and the controller 144 may, e.g., open or close the respective supply damper and/or return for the zone in which the temperature control module 1000 is located (or otherwise adjust the position of the supply damper and/or return to an intermediate position between fully opened and fully closed) and/or activate or adjust a speed of the fan 74, so that the temperature in the zone may be adjusted to meet the temperature setting. It should be understood that the return for the zone in which the temperature control module 1000 is located, as described in this paragraph, may be a common return for more than one zone or may be a dedicated return for the specific zone in which the temperature control module 1000 is located.

Figure 7:
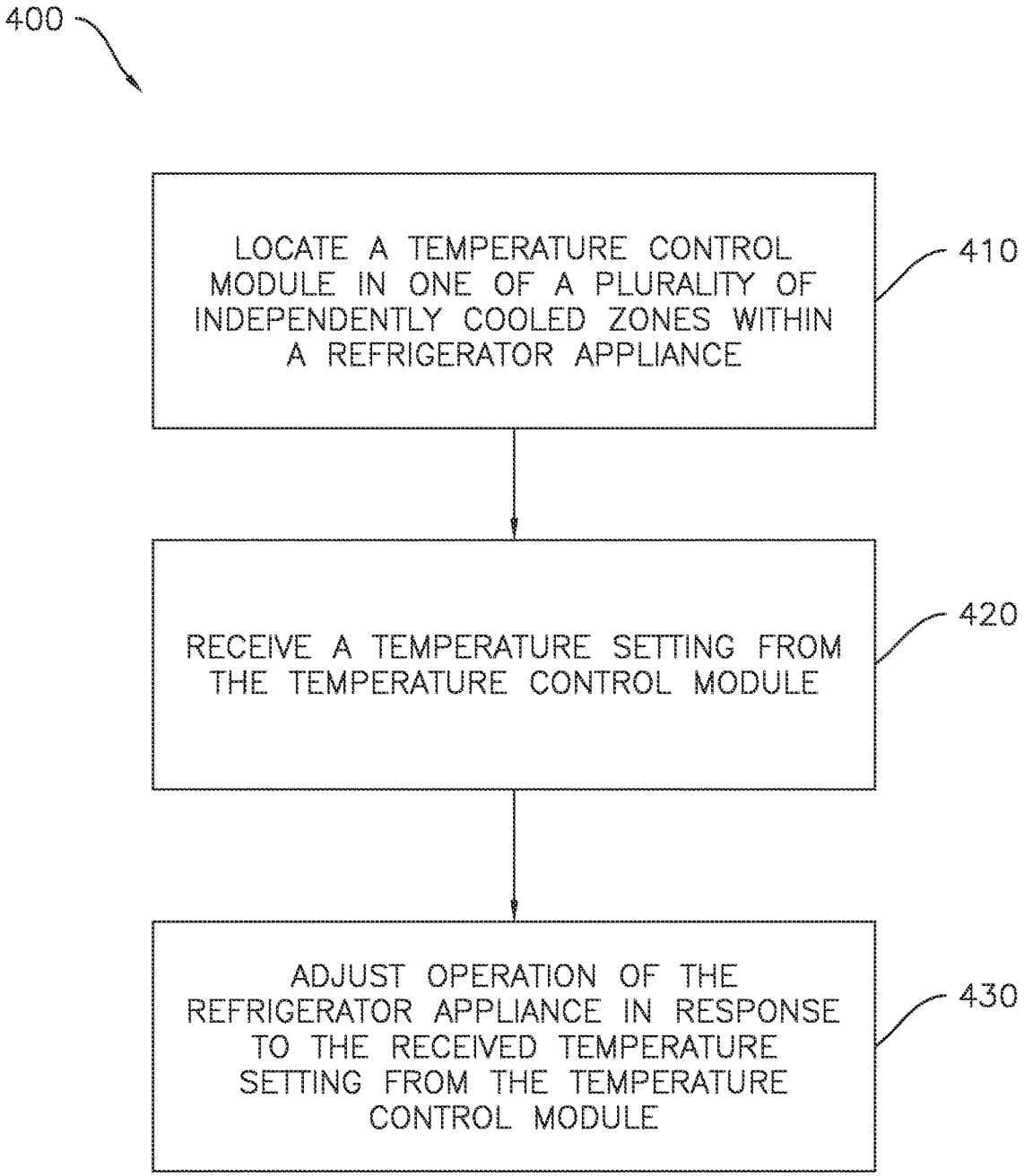
FIG. 7 provides a flow chart illustrating an exemplary method of operating a refrigerator appliance according to one or more exemplary embodiments of the present subject matter.

Turning now to FIG. 7, embodiments of the present disclosure also include methods of operating a refrigerator appliance, such as the example refrigerator appliance 100 illustrated in FIGS. 1 and 2, etc., where the method 400 illustrated in FIG. 7 is one example of such methods.

As illustrated at 410 in FIG. 7, the method 400 may include (and/or a controller, such as controller 144 described above, of the refrigerator appliance may be configured for) locating a temperature control module, e.g., the temperature control module 1000 described above, which is disposed in one zone of a plurality of independently cooled zones within the refrigerator appliance. For example, in various embodiments, locating the temperature control module may include triangulating a wireless signal from the temperature control module with a plurality of wireless receivers and/or receiving a signal from a mechanical switch in one of the plurality of zones and locating the temperature control module based on the received signal.

Continuing to step 420, the method 400 may also include (and the controller may also be configured for) receiving a temperature setting from the temperature control module. The temperature setting may first be received by the temperature control module from a user interface of the temperature control module or from a remote user interface device.

After receiving the temperature setting, the method 400 may also include adjusting operation of the refrigerator appliance, e.g., adjusting operation of at least one of the sealed cooling system and the multi-flow system, in response to the received temperature setting from the temperature control module.

For example, the adjustment in response to the temperature setting may be based on a difference between a measured current temperature within the zone in which the temperature control module is disposed (located) and the temperature setting. The current temperature in the zone may be measured by a stationary temperature sensor which is fixed in place within the refrigerator appliance and in communication, e.g., via a wired connection, with the controller. In such embodiments, the refrigerator appliance may include a plurality of stationary temperature sensors, each stationary temperature sensor positioned and configured to measure a temperature in one of the zones, such that the measured current temperature in the zone in which the temperature control module is disposed is measured by the stationary temperature sensor corresponding to the selected zone.

As another example, in some embodiments, the temperature control module may include a temperature sensor, such as a thermistor or other suitable temperature sensor, onboard the temperature control module. In such embodiments, the current temperature within the selected zone in which the temperature control module is disposed (located) may also or instead be measured by the temperature control module. In such embodiments, the temperature control module may transmit both the temperature setting and the measured current temperature to the controller, e.g., wirelessly. In some embodiments, the temperature sensor onboard the temperature control module may be a contact temperature sensor. Thus, the temperature control module may be placed in contact with a selected food item, such as in direct physical contact, and the operation of the refrigerator appliance may be adjusted to provide a desired temperature for the food item with which the temperature control module 1000 is in contact.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet;

at least one food storage chamber defined in the cabinet;

a sealed cooling system in fluid communication with the at least one food storage chamber via a multi-flow system;

a plurality of zones within the at least one food storage chamber, the multi-flow system configured to selectively direct air cooled by the sealed cooling system to one or more of the zones, whereby each zone is cooled independently of every other zone;

a temperature control module selectively positionable in one of the plurality of zones; and a controller in operative communication with the multi-flow system, the controller configured for:

locating the temperature control module by determining the temperature control module is located in a first zone of the plurality of zones within the at least one food storage chamber, receiving a first temperature setting from the temperature control module, adjusting operation of at least one of the sealed cooling system and the multi-flow system in response to the received first temperature setting from the temperature control module to cool the first zone in which the temperature control module is located to the first received temperature setting, determining that the temperature control module is located a second zone of the plurality of zones within the at least one food storage chamber after determining the temperature control module is located in the first zone of the plurality of zones within the at least one food storaue chamber and adjusting operation of the at least one of the sealed cooling system and the multi-flow system in response to the first temperature setting, receiving a second temperature setting from the temperature control module after determining that the temperature control module is located in the second zone of the plurality of zones within the at least one food storage chamber, and adjusting operation of at least one of the sealed cooling system and the multi-flow system in response to the received second temperature setting from the temperature control module to cool the second zone in which the temperature control module is located to the second received temperature setting.

2. The refrigerator appliance of claim 1, wherein the controller is configured for receiving a wireless signal from the temperature control module and locating the temperature control module based on the received wireless signal.

3. The refrigerator appliance of claim 1, further comprising a plurality of wireless receivers spaced apart from each other throughout the cabinet, wherein the controller is in operative communication with the plurality of wireless receivers and is configured for locating the temperature control module by triangulating the received wireless signal with the plurality of wireless receivers.

4. The refrigerator appliance of claim 1, further comprising a plurality of docking ports, each docking port of the plurality of docking ports defined within a respective zone of the plurality of zones and each zone of the plurality of zones having one respective docking port of the plurality of docking ports defined therein, wherein each docking port comprises a mechanical switch therein, each docking port of the plurality of docking ports configured to receive the temperature control module, whereby the respective mechanical switch of the docking port in which the temperature control module is received is actuated by the temperature control module, the controller in operative communication with each mechanical switch and configured to locate the temperature control module based on a signal received from the mechanical switch of the docking port in which the temperature control module is received.

5. The refrigerator appliance of claim 1, wherein the temperature control module comprises a user interface for receiving the first temperature setting from a user.

6. The refrigerator appliance of claim 1, wherein adjusting operation of at least one of the sealed cooling system and the multi-flow system in response to the received first temperature setting from the temperature control module comprises adjusting the multi-flow system to cool the first zone in which the temperature control module is located to the received first temperature setting.

7. The refrigerator appliance of claim 6, wherein the multi-flow system comprises a plurality of dampers, each damper of the plurality of dampers positioned in or proximate to a respective one zone of the plurality of zones, wherein adjusting the multi-flow system to cool the first zone in which the temperature control module is located to the received first temperature setting comprises adjusting a position of the damper of the plurality of dampers positioned in or proximate to the first zone in which the temperature control module is located.

8. The refrigerator appliance of claim 1, further comprising a plurality of stationary temperature sensors positioned in fixed locations within the cabinet, each temperature sensor of the plurality of stationary temperature sensors positioned in or proximate to a respective one zone of the plurality of zones, and wherein the controller is in operative communication with the plurality of stationary temperature sensors and is configured for adjusting operation of at least one of the sealed cooling system and the multi-flow system based on a current temperature measured by one stationary temperature sensor of the plurality of stationary temperature sensors and the received first temperature setting from the temperature control module.

9. The refrigerator appliance of claim 1, wherein the temperature control module comprises a temperature sensor, and wherein the controller is configured for receiving a temperature reading and the temperature setting from the temperature control module.

10. The refrigerator appliance of claim 9, wherein the temperature sensor of the temperature control module is a contact temperature sensor.

11. A method of operating a refrigerator appliance, the refrigerator appliance comprising a cabinet with at least one food storage chamber defined in the cabinet, a sealed cooling system in fluid communication with the at least one food storage chamber via a multi-flow system, a plurality of zones within the at least one food storage chamber, the multi-flow system configured to selectively direct air cooled by the sealed cooling system to one or more of the zones, whereby each zone is cooled independently of every other zone, and a temperature control module selectively positionable in one of the plurality of zones, the method comprising:

locating the temperature control module by determining the temperature control module is located in a first zone of the plurality of zones within the at least one food storage chamber;

receiving a first temperature setting from the temperature control module;

adjusting operation of at least one of the sealed cooling system and the multi-flow system in response to the received first temperature setting from the temperature control module to cool the first zone in which the temperature control module is located to the first received temperature setting;

determining that the temperature control module is located in a second zone of the plurality of zones within the at least one food storage chamber after determining the temperature control module is located in the first zone of the plurality of zones within the at least one food storage chamber and adjusting operation of the at least one of the sealed cooling system and the multi-flow system in response to the first temperature setting;

receiving a second temperature setting from the temperature control module after determining that the temperature control module is located in the second zone of the plurality of zones within the at least one food storage chamber; and adjusting operation of at least one of the sealed cooling system and the multi-flow system in response to the received second temperature setting from the temperature control module to cool the second zone in which the temperature control module is located to the second received temperature setting.

12. The method of claim 11, further comprising receiving a wireless signal from the temperature control module, wherein the step of locating the temperature control module comprises locating the temperature control module based on the received wireless signal.

13. The method of claim 12, wherein the step of receiving the wireless signal comprises receiving the wireless signal with a plurality of wireless receivers spaced apart from each other throughout the cabinet, and wherein the step of locating the temperature control module based on the received wireless signal comprises triangulating the received wireless signal with the plurality of wireless receivers.

14. The method of claim 11, wherein the refrigerator appliance further comprises a plurality of docking ports configured to receive the temperature control module, and wherein the step of locating the temperature control module comprises locating the temperature control module based on a signal received from a mechanical switch of the docking port in which the temperature control module is received.

15. The method of claim 11, further comprising receiving the first temperature setting by the temperature control module via a user interface of the temperature control module.

16. The method of claim 11, wherein adjusting operation of at least one of the sealed cooling system and the multi-flow system in response to the received first temperature setting from the temperature control module comprises adjusting the multi-flow system to cool the first zone in which the temperature control module is located to the received temperature setting.

17. The method of claim 16, wherein the multi-flow system comprises a plurality of dampers, each damper of the plurality of dampers positioned in or proximate to a respective one zone of the plurality of zones, wherein adjusting the multi-flow system to cool the first zone in which the temperature control module is located to the received first temperature setting comprises adjusting a position of the damper of the plurality of dampers positioned in or proximate to the first zone in which the temperature control module is located.

18. The method of claim 11, further comprising receiving a current temperature measured by one stationary temperature sensor of a plurality of stationary temperature sensors positioned in fixed locations within the cabinet, each temperature sensor of the plurality of stationary temperature sensors positioned in or proximate to a respective one zone of the plurality of zones, and wherein the step of adjusting operation of at least one of the sealed cooling system and the multi-flow system is based on the received current temperature from the one stationary temperature sensor and the received first temperature setting from the temperature control module.

19. The method of claim 11, further comprising receiving a temperature reading from the temperature control module.

20. The method of claim 19, where the temperature reading from the temperature control module is measured by direct physical contact with a food item in the refrigerator appliance.

* * * * *